United States Patent [19]

Wessells

[11] 3,940,522

[45] Feb. 24, 1976

[54] SYNTHETIC FIBERS AND PILE FABRICS MADE THEREFROM

[75] Inventor: John Humphrey Wessells, Signal Mountain, Tenn.

[73] Assignee: E. I. Du Pont de Nemours and Company, Wilmington, Del.

[22] Filed: Aug. 2, 1973

[21] Appl. No.: 384,952

Related U.S. Application Data

[63] Continuation of Ser. No. 147,627, May 27, 1971, abandoned, which is a continuation-in-part of Ser. No. 46,609, June 16, 1970, abandoned.

[52] U.S. Cl. ..... 428/17; 156/72; 428/92; 428/373; 428/374; 428/397

[51] Int. Cl.[2] ..... D03D 27/00; D04H 11/00

[58] Field of Search ..... 161/21, 62–67, 161/172, 173, 175, 176, 177; 156/72, 325; 28/72, 78

[56] References Cited

UNITED STATES PATENTS

| | | | |
|---|---|---|---|
| 3,293,723 | 12/1966 | Evans | 161/62 |
| 3,551,263 | 12/1970 | Carter | 161/21 |

*Primary Examiner*—Marion E. McCamish

[57] ABSTRACT

A cut pile fabric is produced using a grass-like fiber and, optionally, a crimped or crimpable fiber of lower denier than said grass-like fiber plied therewith. The pile fabric made from such fibers has improved aesthetics (e.g., appearance) and mechanical (e.g., frictional) properties, and closely simulates natural turf.

15 Claims, 5 Drawing Figures

INVENTOR

JOHN H. WESSELLS

BY Eugene Berman

ATTORNEY

SYNTHETIC FIBERS AND PILE FABRICS MADE THEREFROM

BACKGROUND OF THE INVENTION

Related Applications

The present application is a continuation of application Ser. No. 147,627, filed on May 27, 1971 which, in turn, is a continuation-in-part of co-pending application Ser. No. 46,609, filed June 16, 1970 both of which applications are now abandoned.

FIELD OF THE INVENTION

The present invention relates to synthetic turf fibers and pile fabrics made therewith. More particularly, the invention relates to grass-like fibers and synthetic pile fabrics of such fibers either alone or in combination with lower denier crimped or crimpable fibers.

DESCRIPTION OF THE PRIOR ART

A number of synthetic products have been introduced to provide both indoor and outdoor surfaces which simulate the appearance and mechanical properties of natural grass but have far greater resistance to damage and require less maintenance. Ribbon-like fibers have been used to give the appearance of grass. However, the products heretofore have failed to simulate natural turf in several important respects. In appearance, prior art articifical turfs have shown an unnatural uniformity of fiber length, dimensions, luster and color. In feel and mechanical properties, the previously mentioned uniformities have also been unnatural. The unnatural appearance and behavior of artificial turfs of the prior art are due in part to the departure of the ribbon-like fibers from the mechanical response and non-uniformity of natural grass blades. In addition, the fibers have shown an inability to stand substantially perpendicular to the backing. Instead, they bend predominantly in one direction of the fabric, and have the flat sides of the fibers predominantly aligned in one direction. This is particularly annoying when the fabric is used as a golf putting green in which case the roll of the golf ball is affected by the direction in which the pile fibers bend. This tendency of ribbon pile fibers to bend is caused at least in part by the need for a certain length of fiber to provide the desired resiliency and other properties. Furthermore, fibers which are stiff enough to resist bending and yet long enough to provide resiliency tend to be unnaturally harsh and abrasive when a player falls on the surface, particularly in a direction opposed to the predominant bend of the fibers.

SUMMARY OF THE INVENTION

A fiber of a synthetic polymeric material having a unique cross-section comprising two webs joined together by a rib to form a V-cross-section having an included angle of not greater than 160° is provided. Assemblies of this fiber are grass-like in appearance and mechanical response.

A cut pile fabric having a unique pile layer is also provided. The pile layer comprises a multiplicity of fibers extending from a backing and secured thereto by adhesive in a conventional manner. The multiplicity of fibers is unique in comprising grass-like fibers having two webs joined together and a rib to form a V-cross-section and having a denier per fiber of between about 200 and about 1500 and a major dimension of cross-section of at least about 0.02 inch and, optionally, crimped fibers having a denier per fiber of between about 6 and about 150. The grass-like fibers and the crimped fibers each comprise at least about 10 weight percent of the multiplicity of fibers. The denier-per-fiber ratio of the grass-like fibers to that of the crimped fibers is usually greater than about 3:1.

In the preferred process pile fabric is prepared by utilizing a unique pile yarn, namely a combined yarn comprising yarn of the above-mentioned grass-like fiber and yarn of the above-mentioned crimped fiber (wherein the crimp may be developed or latent).

The pile fabric has improved aesthetics (e.g., appearance) and mechanical (e.g., frictional) properties and closely simulates natural turf.

DETAILED DESCRIPTION OF THE DRAWINGS

Figure 1:
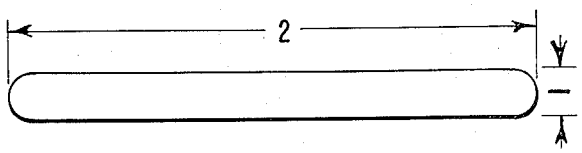
FIG. 1 is the cross-section of a fiber useful as the grass-like portion of the combined pile yarn of this invention.

In FIG. 1, the thickness of the ribbon-shaped fiber is shown in cross-section having a thickness designated as 1. The width of the fiber cross-section is 2, and the ends of the fiber cross-section may be semi-circular, as illustrated.

Figure 2:
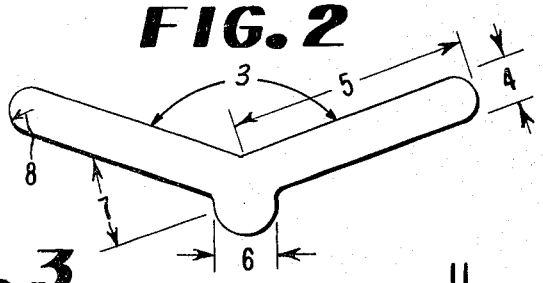
FIG. 2 is the cross-section of the orifice for making the preferred fiber of the invention which is useful as the grass-like portion of the combined yarn of the invention and which simulates closely the appearance and mechanical properties of natural grass.

In FIG. 2, the cross-section of an orifice for making a "grass-blade" fiber having a rib and two webs forming a partially folded cross-section is shown. The thickness of the webs is designated as 4, the width of the webs is 5, the diameter of the central semi-circular rib is 6, the angle of deviation between the two webs is 7, and the radius of the rounded ends of the web is 8. The included angle between the webs is 3.

Figure 3:
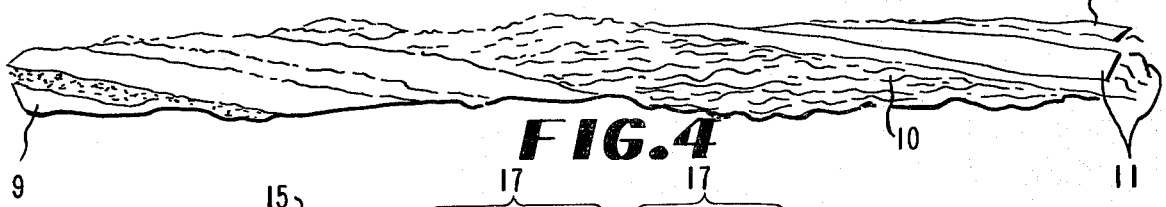
FIG. 3 is a typical combined yarn of this invention as it appears when wound on a package.

In FIG. 3, a combined yarn 9 composed of yarn 10, a plurality of continuous fibers, and one or more grass-like fibers 11 is shown. Yarn 10 will usually show at least some degree of visible crimp when wound on the shipping package. One or more grass-like fibers 11 are plied with the yarn 10 in such a way that a flat dimension of a grass-like fiber can continually shift its position in relation to the multifiber bundle and to the other grass-like fibers to that when the combined yarn becomes pile of an artificial turf fabric there is little chance that fibers of adjacent tufts will be aligned similarly.

Figure 4:
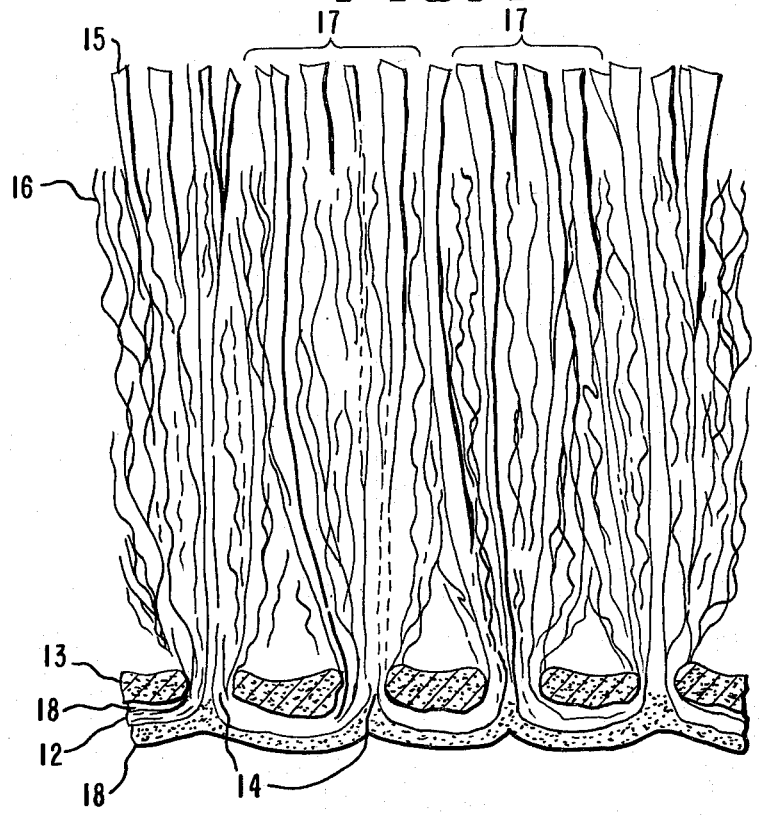
FIG. 4 is an edge view of a tufted cut pile fabric after finishing.

In FIG. 4, combined yarn 12 penetrates backing material 13 at a series of holes 14 made by a tufting needle. This view is taken transverse to the normal direction of progression of the fabric through the tufting operation, for exapmle, from left to right. Grass-like fibers 15 retain nearly their length as when the pile loops are cut, less shrinkage of perhaps 15%. Fibers 16 of the multifiber yarn may have retracted considerably through crimp formation or enhancement, and in so doing they have pressed sideways to meet the fibers of the adjacent tufts 17 and thus fill the space between the tufts to hide the backing and support adjacent tufts perpendicular to the backing. The portions of the fibers 16, which are in or near holes 14, also attempt to develop additional crimp, and in so doing they expand to fill the hole tightly and grip the grass-like fibers to prevent them from sliding and being removed from the fabric accidentally before adhesive material 18 is applied to secure the fibers to the backing 13.

Figure 5:
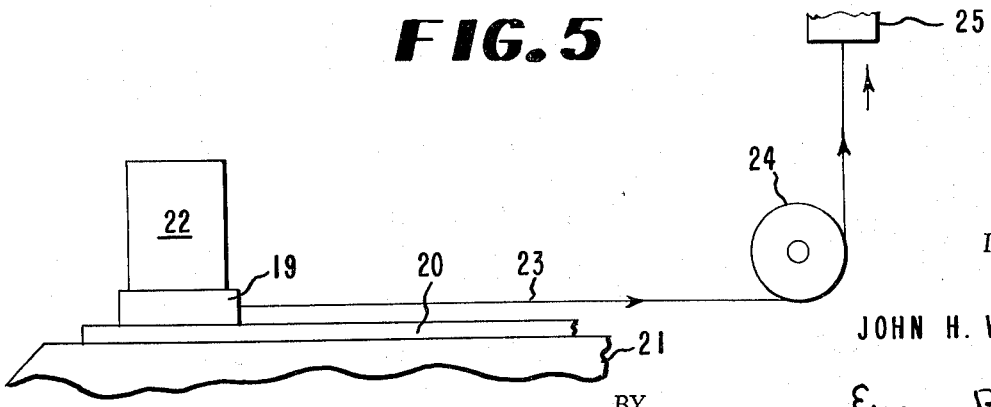
FIG. 5 is the apparatus used for testing frictional properties of fabric of this invention.

In FIG. 5, sledge 19, which consists of polished aluminum, rests on the surface of the pile fabric 20 which is attached to base 21. Weight 22 is added to sledge 19 to provide a loading typical of normal usage. Cord 23 is attached to sledge 19, is turned 90° about low friction pulley 24, and is attached at the other end to crosshead 25 of an Instron Tensile Testing Machine which is instrumented to record the tension on cord 23 as sledge 19 is pulled across fabric 20.

DETAILED DESCRIPTION OF THE INVENTION

Grass-like Fibers

The term "grass-like fiber," as used herein, includes fibers having a generally elongated shape which may be rectangular in cross-section but may also be oval, diamond-shaped, arcuate, ribbon-like with a central rib to resist excessive bending and curling, or of substantially rectangular cross-section with a striated surface to deluster and improve the appearance. The major dimension of cross-section should be at least about 0.02 inch since it has been found that the average human eye cannot distinguish a flattened fiber as grass-like at normal viewing distance if the major dimension is less than that amount. Preferably, the major dimension should be at least 0.03 inch. The lower limit of denier for fibers of such major dimension is about 200 without becoming impractically thin and limp.

The preferred grass-like fiber for use in this invention is that having a "grass-like" cross-section and, nominally, the configuration and dimensions of FIG. 2. Actually, such grass-like fibers prepared by melt spinning or wet spinning through an orifice having the configuration and dimensions of FIG. 2 exhibit cross-sections less nearly geometrically perfect than the orifice. The shrinkage and surface tension forces operating during the cooling and solidification of the spun fibers cause the thickness 4 of the web to decrease at the ends 8 of the web and each web to become arcuate so the grass-like fiber may be said to be "bi-arcuate" or "gullwing" in cross-section. Such a configuration has unexpectedly and surprisingly been found to exhibit desirable features. The optical density and color density of such fibers varies from the edge to the center in a manner not unlike natural grass and thus overcomes the unnatural and artificial oneness of color or monochromatic characteristic associated with filaments having a substantially rectangular cross-section. This reduces or eliminates the need for a plurality of filaments of different hues and colors. Furthermore, these grass-like fibers of "bi-arcuate" cross-section have less tendency to fibrillate than generally flat and ribbon-like fibers which have been delustered through the incorporation of longitudinal striations during the extrusion process.

Another outstanding characteristic of the grass-like fibers of "bi-arcuate" cross-section is the surprising and unexpected similarity of their mechanical behavior to that of natural grass. Ribbons of rectangular cross-section have only one mode or degree of bending, namely, in the direction perpendicular to the width dimension of the ribbon. In contrast, the grass-like fiber of bi-arcuate cross-section has at least three modes or degrees of bending. Perpendicular to the width dimension, the fiber is elastically stable when bent toward the side of the included angle but is elastically unstable and buckles when bent toward the side of the rib. The fiber may be bent sideways to either side as a third mode of bending. This variation and the cross-sectional shape of the fibers together importantly contribute to the performance characteristics of the fibers when made into a cut pile fabric so that such fabrics exhibit characteristics similar to natural grass or turf. In addition, the recovery of such filaments from deformation is both rapid and nearly complete. This wide variance in mechanical behavior in individual fibers produces in an assembly of such fibers a more uniform, and hence more natural, response to a wide variety of forces. Consequently, a pile fabric constructed of such fibers exhibits isotropic response and less matting.

These desirable characteristics are seen when the included angle 3 is 160° or less. When the included angle exceeds 160°, the mechanical behavior approaches that of fibers of substantially rectangular cross-section.

The departure of the shape of the cross-section of the fiber from the shape of the orifice is a function of the processing conditions. Using the same orifice, the cross-section will vary depending upon the length of the air gap between the spinnerette and the quench bath, the angle of approach to the surface of the bath, the temperature of the bath, the composition of the bath liquid, the travel through the bath, and so forth. For example, when the air gap was varied from 2 inches to 4 inches and the travel through the bath from 1 inch to 12 inches, the included angle of the grass-like fibers spun from 66 nylon under these conditions using an orifice having an included angle of 135° was found to vary from 153° to 180°. Thus, it is possible to introduce a randomness into the synthetic grass-like fibers to simulate the randomness of natural grass simply by according each fiber emerging from a multiorifice spinnerette slightly different treatment. Cut pile fabrics may be constructed from blends of such grass-like fibers; such fabrics closely simulate natural turf.

The grass-like fibers may be "bulked" – that is, subjected to a twist-setting, or false-twisting operation. Means of "bulking" are well known and are described in detail in books such as "Man-Made Textile Encyclopedia" or "Modern Yarn Production" by G. R. Wray. "Bulking" of grass-like fibers in a conventional false-twisting machine such as the "Superloft" No. 550 and No. 552 (Leesona Corp., Warwick, Rhode Island) is described in co-pending application U.S. Ser. No. 846,711 (filed Aug. 1, 1969). Other means of "bulking" are described in U.S. Pat. Nos. 3,543,358, 3,156,028, and 3,186,155.

In order to simulate the randomness of natural grass, it may be desirable to provide more than one denier of grass-like components. Alternatively, the grass-like component may have more than one cross-sectional shape in order to provide a variety of appearance and mechanical properties. It should preferably have a relatively low shrinkage less than 15%, when subjected to finishing operations.

The grass-like fibers may be made from any suitable synthetic polymer by usual spinning techniques. Pigments and materials may be added to the melt to protect the polymer from degradation by ultraviolet light, hydrolysis, oxidation or heat, etc. Where the grass-like fibers consist of more than one cross-sectional shape or fiber denier, these components may be produced separately and combined later or they may be spun simultaneously using spinnerets having differently sized or shaped capillaries.

Crimped or Crimpable Fibers

The crimped and/or latently crimpable fibers may be either continuous filament or staple and may have a variety of fiber cross-sectional shapes.

The term "latently crimpable" as used herein, and generally in the art, refers to an ability of particular fibers to spontaneously develop crimp (generally of spirallike configuration) when exposed to specific treatments such as dry heat, boil-off, dye baths, scour, etc., as more fully illustrated hereinafter. Such spontaneous development of crimp is to be distinguished from a mechanical crimp (e.g., saw-tooth crimp) provided by crimping fibers in a "stuffer-box" crimper.

The cross-sectional shape of the fibers preferably should provide good ability to accept and form crimp, to develop or intensify crimp during the scouring or dyeing operation, and to provide the desired resilience, resistance to matting, firm support for the grass-like fibers, friction, and the other necessary properties. Round and trilobal are among the preferred shapes.

The fibers should have, or have the latent capability of producing, crimp, generally at least about 5 crimps per inch (preferably 10–20 crimps per inch) with an amplitude of at least 5 fiber diameters is suitable.

The most desirable multifiber material is one which has a substantial amount (i.e., at least about 5 crimps per inch of at least the above mentioned amplitude) of crimp at the time of fabric formation, which spontaneously develops additional crimp during the after-treatment of the fabric and which forms crimp in individual fibers in as random as possible a manner, so that the crimps do not nest together but rather the individual fibers push apart as they crimp to form a dense mass giving good support to the grass-like fibers. Fibers which have a substantial amount of crimp in them at the time of tufting push apart to fill the needle hole, thus preventing slippage of both the crimped and the grass-like fibers. The fibers preferably should not draw down tightly against the backing but should remain in a somewhat extended condition to resist compressive load applied more or less axially to the general direction of the fiber. Since compressive resilience is desirable, filaments whose cross-section has not been deformed severely by the crimping operation are particularly useful. This combination of requirements is best met by products of U.S. Pat. No. 3,186,155 or ones made by the process of U.S. Pat. No. 3,156,028. The crimped or crimpable fibers may be spun on conventional equipment and subjected to conventional crimping operations. Crimpable fibers may be produced by introducing differential strains into the fibers at the time of spinning, or two or more polymers having different shrinkage properties may be combined into a single fiber. These fibers may be used either as continuous filament or may be cut to staple and spun by usual methods.

Combined Yarn

The combined yarn should be formed of particular percentage and denier combinations of the grass-like fibers and multifiber strands of crimped and/or crimpable fibers described. Specifically, the grass-like fibers and the fibers of the multifiber strands should each comprise at least about 10 (preferably at least 25) weight percent of the total weight of pile fibers and the denier per fiber ratio of the grass-like fibers to the fiber of the multifiber strand should be greater than about 3:1, preferably greater than about 10:1. These requirements provide the desired mechanical properties in the pile structure made therefrom.

When the grass-like fiber constitutes about 10 weight percent of the pile yarn (and therefore results in the same weight percent of the pile surface of the fabric), the appearance of the pile fabric appears grass-like (rather than carpet-like) and the mechanical and frictional properties change. The most significant improvement in such properties are seen when the preferred amount, about 25 to 75 weight percent of grass-like fibers are utilized. When the crimped and/or latent crimpable fibers constitute less than 10 weight percent, the improvement in such properties becomes less significant and the fabric has the appearance approaching that of 100% grass-like pile fabric.

The pile fibers preferably consist essentially of the grass-like fibers and the crimped and/or latently crimpable fibers described above, although small amounts of other fibers may be present without substantially affecting the properties of the pile structure.

If the fiber denier of the multifiber yarn is too close to that of the grass-like fiber, both the appearance and the mechanical properties are too uniform to simulate grass effectively. Therefore, the ratio of the single fiber denier of the multifiber component to that of the grass-like component should be less than one-third, and, preferably, less than one-eighth.

One or more of the grass-like fibers are combined with an appropriate multifiber strand of crimped and/or latently crimpable fibers, preferably by ply-twisting on conventional plying equipment. When a large number or denier of grass-like fibers is employed, it is preferable to ply-twist half of the grass-like fibers with half of the multifiber yarn and ply two of these yarns together with opposite-hand twist, thus producing a combined yarn which is not twist-lively. When more than two levels of pile are desired, two or more yarns which have been crimped or made crimpable by different processes or two different crimp levels may be utilized so that they will retract to different degrees. Yarns which have been crimped or made crimpable by the same process to the same degree may be tensioned by different amounts after crimping so that the fibers of one yarn are practically straight while those of the other have substantial crimp. When these yarns are plied at the same tension, the yarn having the most crimp will extend more than the other, and after the pile is cut, one will retract more than the other on release of tufting tension.

Yarns of Breen & Lauterbach U.S. Pat. No. 2,985,995 or Weiss & Prokesch U.S. Pat. No. 3,156,028 produced under equal bulking conditions may be treated with different amounts of water or finish under different tensions as described in Williams U.S. Pat. No. 3,271,943 to produce yarns having different degrees of retraction.

In certain instances, the plied yarn may be heat-set, giving the grass-like fibers a permanent spiral form as determined by the degree of ply-twist employed and eliminating twist-liveliness in a single-ply yarn. This spiral prevents the flat sides of the fibers from lying in some predominant plane if any factor in the fabric-making process tends to produce such alignment. Heatsetting, however, also reduces the ability of latently crimpable fibers to retract and, therefore, is usually employed with yarns having a great degree of crimp when wound on a package.

Alternately, the plied yarn may utilize grass-like fibers that have been bulked as previously described. This, too, results in helping to prevent the flat sides of these fibers from lying predominantly in parallel planes if any factor in the fabric-making process tends to produce such alignment. This result may be achieved without destroying the ability of latently crimpable fibers to retract.

The use of the combined yarn described above is preferred for obtaining the improved pile fabric. When fibers of elongated cross-section (e.g., grass-like fibers) are used as the pile of woven, knitted or tufted fabrics, they tend to bend so that the portions of the filaments entering and leaving the base fabric have their major dimensions parallel to each other and to the filling direction of a woven base fabric because the bending modulus of a fiber is least when bent in this manner. In fact, a fiber will strongly resist bending in any other manner and will twist into its preferred parallelism if allowed to do so. However, when grass-like fibers herein are ply-twisted with multifiber yarn as in this invention, the ply twist randomizes the orientation of the grass-like fibers with respect to the backing material, and the multifibers yarn restricts the tendency of the grass-like fibers to twist into parallelism in the resultant pile structure.

Preparation of the Pile Fabric

Pile fabric may be made from the yarns of this invention by weaving, tufting, knitting, or the process of Koller U.S. Pat. No. 3,085,922. The term "pile fabric" as used herein and generally in the art, refers to a fabric with a pile surface; the pile comprises raised loops of fibers which are cut herein and the cut loops form all or part of the surface of the fabric. The yarn used in forming the pile is generally referred to as a "pile yarn." Since tufting is generally preferred for economic reasons, the preparation of tufted pile fabrics will be illustrated hereinafter.

Combined yarn is fed through the needles of a tufting machine and is inserted through a backing material, forming pile loops.

In an alternate procedure to the use of the combined yarn, the grass-like fibers and the crimped and/or latently crimpable fibers are fed to the eye of the same tufting needle each from its own supply package. In effect, this produces a combined yarn at the point of tufting. Feeding the grass-like fibers and the crimped and/or latently crimpable fiber each to its own tufting needle does not, as hereinbefore described, achieve the same results.

The pile loops are then cut by knives to form a "cut pile fabric." If desired, the cutting knives may be adjusted to cut one leg of the loop slightly longer than the other or at an angle so that the grass-like fibers will have somewhat random lengths in the final product, simulating the usual randomness of cut grass.

Unpigmented fabric may be scoured or dyed in water near the boiling point. At this time, crimped fibers which have been partially straightened by the tensions of drafting and spinning in the case of stable fibers or by the tensions of winding and tufting, in the case of continuous filaments, may recover a substantial portion of their previous crimp. Crimpable fibers develop crimp at this time through release of strains imposed during the spinning operation or through differential shrinkage of the individual components of a multicomponent fiber. If pigment is not introduced into the polymer of all components at spinning or if additional shading is desired, the finished fabric may be dyed. The grass-like and the crimpable fibers may accept different amounts of dye and thus dye to different intensities of the same dye color or they may accept different kinds and colors of dyes in a mixed dye bath.

After the fabric is dried, latex, foam, or other adhesive material is applied to the underside of the fabric to secure the pile fibers to the backing and prevent slippage or extraction of fibers. Latex is usually cured in an oven; and if the fabric has been made of pigmented fibers and has not been scoured or dyed, the crimp described above is developed at this time. Neither the backing nor the adhesive material is critical herein; any conventional material of this type can be used.

Both the pile and backing material of the fabrics of this invention are made from materials such as polyamides, polyacrylics, polyesters, and polyolefins which resist weathering and have good mechanical properties. In particular, the pile preferably should have exceptionally good resilience and resistance to light fading and weathering. The fibers preferably should resist tearing, fibrillating and permanently deforming. Polyamides such as nylon 6, nylon 66, nylon 610, nylon 612, and copolymers and blends of these are particularly preferred.

When pile fabric is made by the tufting method, it is desirable to use a backing material which is sufficiently resilient to close on the yarns after the tufting needle is withdrawn and to grip the fibers so that they will not slip through the backing before they have been secured by latex or other tuft-anchoring treatment. Backing materials composed in whole or in part of non-woven fiber mats, resilient foams, or closely woven ribbon fibers are preferred. For instance, when constructing a pile fabric for golf tees, the backing material is selected so that a golf tee may easily be inserted therein or therethrough.

The Pile Fabric

The pile fabric of this invention has improved appearance and mechanical properties in view of the unique pile structure, specifically, the unique combination of grass-like fibers and crimped and/or crimpable fibers of the required denier and percentages, described above. As should be apparent from the above description, the precise form of the fiber in the pile structure of course is dependent upon the pile fabric preparation. For example, when the pile fabric is produced by tufting, the pile will consist of tufts of the fibers. Similarly, when pile loops are cut, the pile fibers, if originally in continuous filament form, are now of staple length. Further, the latent crimpability, if any, will be developed. If some or all of the grass-like fibers have different shrinkage characteristics than other fibers in the pile and/or if latent crimp is developed in crimpable fibers, two or more different levels of pile fiber heights may be present. For example, when fibers are used which are already highly crimped when they are combined with the grass-like fibers, little or no additional crimp development is required during finishing of the fabric. When the pile tufts are cut and the fabric is finished, the height of the crimped filaments may be the same or slightly different from that of the grass-like fibers. On the other hand, when fibers having little visible crimp but having a latent potential for developing crimp, are combined with grass-like fibers, made into pile fabric, and crimp is developed, the crimpable fibers shorten (due mainly to crimp development), and at the same time press laterally against neighboring filaments, to form a distinctly lower pile layer. Although desirable, pile levels are not considered essential herein as long as the crimped fibers as described above, are present. Whether due to developed crimp and/or latent crimp in the yarn, the fibers in the pile structure should be crimped; generally at least about 5 crimps per inch (preferably 10–20 crimps per inch) with an amplitude of at least 5 fiber diameters is suitable. These crimped fibers support the grass-like fibers, contribute a major portion of the resilience of the pile surface and improve the mechanical and frictional properties thereof.

It will be seen that when a foot descends on a pile fabric of this invention, and contact is made with the grass-like fibers, they begin to buckle or bend. When contact is made with the ends of the crimped fibers, the crimped fibers are compressed, as they are pushed out sideways against each other and against the grass-like fibers, thus inhibiting further buckling or bending of the grass-like fibers and permitting them to resist further bending or buckling without the necessity for undue fiber stiffness. Thus, a pile fabric of grass-like fibers and crimpable fibers is less harsh and abrasive than one made entirely of grass-like fibers and the pile fabric of the invention will give superior resilience and recovery.

Particular frictional properties of a fabric may be obtained, for example, by using relatively slippery grass-like fibers and high-friction multifiber yarns, employing a larger proportion or greater pile height of the multifiber yarn if greater friction is desired. Resilience may be selected in a similar manner, so that both the height to which a ball bounces and the degree to which its forward progress is slowed upon contact with a fabric may be predetermined by the properties of the different components, their proportions, and their pile heights.

It has been found that the appearance of products of this invention can be greatly improved by differential coloration of the components. The crimped fibers are preferably a different shade of green from the grass-like fibers or may be a different color such as black or brown. In natural turf, new growing grass blades have a yellowish cast; healthy mature underturf, a deep green or blue-green; and dead stalks and clippings have shades of brown. A dense underturf appears dark. Therefore, it has been found that one desirable combination is a fabric consisting of grass-like fibers of two shades of green, with an underturf in deeper green, blue-green, brown, or black. Another desirable color combination consists of grass-like fibers in a yellow-green shade simulating rapidly growing grass with the underturf in deep blue-green. A third combination is similar except that the underturf consists of a mixture of deep blue-green fibers and black fibers. In the case of fabrics having two-level underturf, the grass-like fibers may, for example, be yellow-green, the higher underturf blue-green, and the lower level black. As the difference in pile heights between the grass-like and other fibers is reduced, color or luster contrast between the two species becomes increasingly desirable. In a fabric having no difference in pile heights, color or luster, the grass-like fibers are difficult to see and the fabric looks more like carpet than turf. However, if the grass-like fibers of such a fabric are made more lustrous than the others by providing a smooth reflecting surface or by providing a concave filament surface to concentrate reflected light, the grass-like nature of the fabric begins to be evident. Color contrast, either alone or combined with luster contrast and pile height difference, further enhances the simulation of turf.

Utility

Products of this invention may be used either indoors or outdoors to simulate the appearance, feel, and mechanical properties of natural turf. Football and baseball playing surfaces, golf greens, tennis courts, and high-wear areas of lawns are particularly suitable uses for this material. It is useful around swimming pools for absorbing water and furnishing a non-skid surface which is soft, non-abrasive, and resists wear.

The invention will be further illustrated by the following examples. Parts and percentages are by weight unless otherwise specified.

EXAMPLE 1

Two continuous grass-like fibers of Du Pont Ruvea polyamide having a denier of 450 each and a cross-section as shown in FIG. 1, having a thickness 1 of 0.0015 inch, a length 2 of 0.050 inch, and semi-circular ends are combined by ply-twisting to 0.5 tpi Z twist with one end of 2600 denier 136 filaments Type 846 Du Pont polyamide bulked continuous filament (referred to as BCF hereinafter) yarn having a denier-per-fiber of 19 and a trilobal filament cross-section. The BCF fiber has greater than about 5 crimps per inch. The combined yarn is used as the pile material in a cut pile fabric tufted on a 5/32-inch gage machine into 3½ oz. Du Pont Typar non-woven polypropylene backing. One fabric of ½-inch pile height, 22 ozs. per square yard, and a second fabric having 5/16-inch pile height and 16 ozs. per square yard are fabricated. The fabrics are then dyed in a 6-inch beck at 210°F. (99°C.) temperature in a bath consisting of 1.20% "Capracyl" yellow NW and 1.00% anthraquinone green GNN. After drying, the pile height of the grass-like fibers is found to be substantially the same as the original cut length, whereas the BCF fibers have retracted by crimp development (approximately 10–20 crimps per inch) to form a pile height of approximately 3/8–7/16 inch in the ½-inch fabric and about one-fourth inch in the 5/16-inch fabric. The backing is hidden by the BCF fiber. The grass-like fibers dye a yellow-green giving the appearance of young growing grass blades, whereas the BCF fibers dye a dark green giving the appearance of darker underturf. The color contrast and pile height difference accentuate the presence of the grass-like fibers. The flat side of the grass-like fibers is located randomly in adjacent tufts. A standard latex binder is applied to the back. Samples of the fabric are subjected to wear, crushing, and handling. The majority of the grass-like fibers are still substantially perpendicular to the backing and those which are noticeably bent are not aligned in any predominant direction.

EXAMPLE 2

Three fibers of the same grass-like 450 denier fiber are plied to 0.5 turns per inch Z twist with one end of 1300 denier 68 filament Type 846 bulked continuous filament polyamide having a trilobal fiber cross-section. They are tufted into fabrics and finished as in Example 1.

EXAMPLE 3

Cut pile fabric prepared as shown in Table I uses a combination of yellow-green melt-pigmented Ruvea fibers and yellow-green skein-dyed polyamide BCF yarn as pile. The yarn components are plied together by twisting and are converted into cut pile fabric by tufting, using 3.5 ozs. per square yard, Typar spunbonded polypropylene as backing. The fabric is coated with latex binder on the back and is cured in an oven at 280°F. (138°C.). The mechanical properties of this fabric are quite satisfactory for use as artificial turf, but the uniform color gives an unnatural appearance.

EXAMPLE 4

A cut pile fabric is prepared as in Table I and Example 3. Both the grass-like and the crimped fibers are pigmented yellow-green.

EXAMPLE 5

A cut pile fabric is prepared as in Table I and Example 3. Both the grass-like and the crimped fibers are pigmented yellow-green.

TABLE I

| Grass-like fiber No. Fils. | Grass-like fiber Den/Fil. | Grass-like fiber No. Ends | Grass-like fiber Den. | Multifiber BCF or Other Yarn Type | Multifiber BCF or Other Yarn Den/Fil. | Multifiber BCF or Other Yarn Ply Twist | Tufting Gauge (ins.) | Pile Height (as tufted) (ins.) | Pile Height (After heating) (ins.) Grass-like Fiber | Pile Height (After heating) (ins.) Crimped Fiber | Oz./sq. yd. |
|---|---|---|---|---|---|---|---|---|---|---|---|
| 3 | 500 | 1 | 1300 | Type 846 polyamide BCF | 19 | 1.5 | 5/32 | 7/16 | 7/16 | 5/16–3/8 | 46 |
| 3 | 650 | 1 | 1600 | Pigmented BCF (Round fils) | 19 | 3.0 | 3/16 | 1/2 | 1/2 | 7/16 | 42 |
| 3 | 650 | 1 | 1600 | Pigmented BCF (Round fils) | 40 | 3.0 | 3/16 | 1/2 | 1/2 | 7/16 | 42 |
| 4 | 500 | 1 | 1.0cc | Spun Orlon | 15 | .75 | 1/8 | 1/2 | 1/2 | 3/8–7/16 | 42 |
| 6 | 700 | 2 | 1760 | Pigmented BCF (Round fils) | 52 | 2.0Z/1.5S | 3/16 | 7/16 | 7/16 | 3/8 | 42 |
| 4 | 700 | 2 | 1670 | Pigmented BCF (Round fils) | 19 | 2.0Z/1.5S | 3/16 | 7/16 | 7/16 | 3/8–7/16 | 42 |
| 4 | 500 | 7 | 1050 | Vylor polyamide (Round fils) | 150 | 1.5 | 5/32 | 1/2 | — | — | 40 |
| 8 | 450 | 1 | 2700 | Vylor polyamide (Round fils) | 150 | — | 5/32 | 1/2 | 1/2 | 1/2 | 40 |
| 8 | 450 | — | — | — | — | — | 5/32 | 5/8 | 1/2 | — | 39 |

EXAMPLE 6

A cut pile fabric is prepared as in Table I. Four fibers of 500 denier Ruvea are plied with one end of 1.00 cotton count Orlon acrylic spun staple yarn made from a mixture of equal parts of solution dyed black and green staple fibers. The fabric is prepared as in Example 3.

EXAMPLE 7

A polyamide fiber having a denier of 700 and a cross-section as shown in FIG. 2 has a web thickness 4 of 0.003 inch, arm length 5 of 0.015 inch, rib diameter 6 of 0.006 inch, an angle of deviation 7 of 20°, and end radius 8 of 0.0015 inch. Three of these filaments pigmented yellow-green and one end of 1760 denier blue-green pigmented BCF polyamide yarn are plied with 2.0 turns per inch Z twist. Two of these yarns are then plied together using 1.5 turns per inch S twist. The yarn has much less tendency to untwist and kink than those of the preceding examples, looking and behaving more like a braided yarn. The fabric is prepared as in Example 3. The fibers of FIG. 2 give an appearance more like natural grass than those of the previous examples. Mechanically, these filaments are stiffer, offering greater resistance to bending and giving greater resiliency.

EXAMPLE 8

The grass-like fibers of Example 7 are plied with one end of 1670 denier pigmented blue-green BCF polyamide yarn using 2.0 tpi Z twist. Two of these yarns are plied using 1.5 tpi S twist. The fabric is prepared as in Example 3.

EXAMPLE 9

Four continuous grass-like fibers of Du Pont Ruvea pigmented polyamide having a denier of 500 each and a cross-section as shown in FIG. 1, having a thickness 1 of 0.0023 inch, a length 1 of 0.033 inch and semicircular ends are combined by ply-twisting to 1.5 tpi Z twist with seven round fibers of Du Pont Vylor pigmented polyamide continuous filament having a denier per fiber of 150. The combined yarn is used as the pile material in a cut-pile fabric tufted on a 5/32 inch gauge machine into a 3.5 oz. Du Pont Typar non-woven polypropylene backing. A fabric of ½ inch pile height, 40 oz. per square yard is fabricated.

The grass-like fibers give the appearance of young growing grass blades extending above the dense formed fibers which look not unlike fescue. The difference in texture gives the appearance of a natural lawn of different grasses. A standard latex binder is applied to the back. Samples of fabric are subjected to wearing, cutting, and handling. The majority of the grass-like fibers are still substantially perpendicular to the backing and those which are noticeably bent are not aligned in any predominant direction.

EXAMPLE 10

Eight continuous grass-like fibers of Du Pont Ruvea polyamide having a denier of 450 each and a cross-section as shown in FIG. 2, having a web thickness 4 of 0.003 inch, an arm length 5 of 0.015 inch, a rib diameter 6 of 0.006 inch, an angle of deviation 7 of 20°, and semicircular end radius 8 of 0.015 inch is combined by ply-twisting to 0.5 tpi Z twist with one end of 2700 denier 18 filaments Du Pont "Vylor" polyamide continuous filament yarn having a denier-per-fiber of 150 and a round cross-section. The combined yarn is used as the pile material in a cut pile fabric tufted on a 5/32-inch gage machine into 3 ½ oz. Du Pont Typar non-woven polypropylene backing. A fabric of ½-inch pile height, 40 ozs. per square yard is fabricated. The backing is hidden by the "Vylor" fiber. The grass-like fibers give the appearance of young growing grass blades, whereas the "Vylor" fibers give the appearance of under-turf of fescue. The color contrast and pile height difference accentuate the presence of the grass-like fibers. The flat side of the grass-like fibers is located randomly in adjacent tufts. A standard latex binder is applied to the back. Samples of the fabric are subjected to wear, crushing, and handling. The majority of the grass-like fibers are still substantially perpendicular to the backing and those which are noticeably bent are not aligned in any predominant direction.

EXAMPLE 11

Four fibers having the same bi-arcuate cross-section as that of Example 10 and that had been bulked using the process described in U.S. Pat. No. 3,156,028 are plied with four other ends of the same fiber to 0.5 tpi Z twist. The combined yarn of eight ends is used as the pile material in a cut pile fabric tufted on a ⅜ inch gage machine into a 3½ oz. Du Pont Typar non-woven polypropylene backing. A fabric having a pile height of one-half inch, 39 oz. per square yard, is fabricated. A latex binder is applied to the back and it is noted that binder penetration and holding power is improved by the presence of the bulked fibers. Compared to artificial turfs constructed similarly from ribbons of substantially rectangular cross-section, it feels less harsh.

The fabrics of Examples 3–8 have been tested for coefficient of friction, with two additional artificial turfs being added for comparison purposes. One consists of woven pile fabric in which the pile material is formed solely from three fibers, each of approximately 400 denier and having approximately dimensions of 0.002 inch thickness and 0.020 inch width, assembled in stacked relationship with flat sides parallel to each other and folded about the filling thread of the base fabric so that the flat sides of the fibers in the final cut pile construction are all essentially parallel to the filling of the base fabric. Furthermore, this fabric which has not been subjected to prior testing has all of the fibers deviating from vertical in a single warpwise direction by angles of 15°–60°. The cut length of the pile filaments is approximately seven-sixteenths inch. An additional fabric is a knitted cut pile fabric wherein the pile is composed solely of approximately 50 denier pigmented crimped fibers. Pile height is one-half inch, and pile weight is approximately 48 oz./yd.$^2$.

Test Procedures

Coefficient of friction is measured using the apparatus of FIG. 5, in which the Instron Tensile Testing Machine crosshead 25 moves upward at a rate of 10 inches per minute (25.4 cm. per minute). The sledge 19 is made of polished aluminum weighing 200 grams and has a surface in contact with the fabric of 55 mm. by 63.5 mm. and an area of 3630 sq. mm. An additional weight 22 of 2265 grams is placed on the sledge, giving a combined weight of 2465 grams or 68 grams per sq. cm. pressure. The force required to start the sledge moving is used to calculate the static coefficient of friction, $\mu_s$. The average force to maintain motion is used in calculating the dynamic coefficient of friction, $\mu_d$. Following measurements of coefficient of friction against the dry material, all samples are conditioned 24 hours at 65% relative humidity and 70°F. (21°C.) and are then wet by transferring 0.5 cc. of water per 1 sq. cm. of carpet from a sponge cloth. Wet friction measurements are then made.

Each fabric sample is tested for friction with the sledge moving in the machine direction (MD) which is the normal direction of motion of a base fabric through a tufting machine and again in a crosswise direction (XD) at right angles to the previous measurement. In the case of 100% grass-like fibers, where the fibers bend preferentially in the machine direction of the fabric, measurements are made both with and against the direction of bend. The results are shown in Table 2. Differences between friction measurements in the machine direction and the crosswise direction indicates the degree of directionality of the fabric. The large difference in friction measurements in the 100% grass-like fiber pile when measured with and against the direction of predominant bend of the fiber demonstrates the non-uniform properties of the fabric.

TABLE II

| EXAMPLE | DIRECTION | COEFFICIENT OF FRICTION DRY | | WET | |
|---|---|---|---|---|---|
| | | $\mu_s$ | $\mu_d$ | $\mu_s$ | $\mu_d$ |
| 3 | MD | .48 | .42 | .46 | .40 |
| | XD | .50 | .44 | .42 | .40 |
| 4 | MD | .48 | .42 | .40 | .36 |
| | XD | .48 | .40 | .48 | .32 |
| 5 | MD | .47 | .33 | .48 | .39 |
| | XD | .49 | .36 | .55 | .44 |
| 6 | MD | .45 | .38 | .48 | .40 |
| | XD | .44 | .38 | .40 | .32 |
| 7 | MD | .44 | .38 | .38 | .32 |
| | XD | .38 | .38 | .35 | .31 |
| 8 | MD | .48 | .44 | .44 | .35 |
| | XD | .42 | .40 | .38 | .35 |
| 100% grass-like fiber (with bend) | MD | .43 | .36 | .34 | .28 |
| 100% grass-like fiber (against bend) | MD | .36 | .26 | .26 | .20 |
| | XD | .36 | .28 | .30 | .30 |
| 100% BCF crimped fibers | MD | .50 | .46 | .52 | .44 |
| | XD | .52 | .46 | .48 | .40 |

What is claimed is:

1. Fabric comprising a backing and a multiplicity of fibers extending from said backing in the form of a cut pile layer and being secured thereto by an adhesive, said multiplicity of fibers comprising:

grass-like fibers comprising a rib and two webs which form a partially folded structure of bi-arcuate cross-section and having a denier per fiber of about 200 to 1500 and a major dimension of cross-section of at least about 0.02 inch, and crimped fibers having a denier per fiber of about 6 to 150, with the proviso that:

1. said grass-like fibers and said crimped fibers each comprise at least about 10 weight percent of said multiplicity of fibers, and
2. the denier-per-fiber ratio of the said grass-like fibers to the said crimped fibers is greater than about 3:1.

2. Fabric comprising a backing and a multiplicity of fibers extending from said backing in the form of a cut pile layer being secured thereto by an adhesive, said multiplicity of fibers comprising grass-like fibers of a polyamide of bi-arcuate cross-section having a denier-per-fiber of 200–1500 and having two webs joined together and a rib of up to twice the thickness of said webs forming a V-cross-section having an included angle not greater than 160°.

3. The fabric of claim 2 wherein said grass-like fiber is bulked.

4. Fabric comprising a backing and a multiplicity of fibers extending from said backing in the form of a cut pile layer and being secured thereto by an adhesive, said multiplicity of fibers comprising:

grass-like fibers of bi-arcuate cross-section having a denier-per-fiber of 200 to 1500 and two webs joined together and a rib forming an included angle of not greater than 160° and crimped fibers having a denier-per-fiber of 6 to 330.

5. A grass-like fiber of a synthetic polymeric material of bi-arcuate cross-section having a denier-per-fiber of 200 to 1500 and having two webs joined together and a rib.

6. The fiber of claim 5 having an included angle of not greater than 160°.

7. The fiber of claim 5 wherein the length in cross-section of each of said webs is greater than 0.01 inch.

8. The fiber of claim 7 wherein the thickness at said rib is up to twice that of said webs.

9. The fiber of claim 8 wherein said webs are non-planar.

10. The fiber of claim 9 whrein said synthetic polymeric material is a polyamide.

11. The fiber of claim 10 wherein said fiber is bulked.

12. A combined yarn comprising a first yarn comprising at least one grass-like fiber of a synthetic polymeric material having a denier-per-fiber of 200 to 1500 and having two webs joined together and a rib to form a V-cross-section having an included angle of not greater than 160°, plied together with a second yarn comprising fibers having a denier per fiber of 6 to 330.

13. The combined yarn of claim 12 wherein said second yarn comprises crimped or latently crimpable fibers.

14. The combined yarn of claim 13 wherein said first yarn comprises crimped or latently crimpable fibers.

15. The combined yarn of claim 12 which has been bulked.

* * * * *